US006028269A

United States Patent [19]

Kunieda et al.

[11] Patent Number: 6,028,269

[45] **Date of Patent: *Feb. 22, 2000**

[54] SET OF HOLLOW AND TAPERED COMPOSITE INSULATORS WITH A ONE PIECE CORE

[75] Inventors: Shigehiko Kunieda, Iwakura; Isao Nakajima; Yusuke Utsumi, both of Nagoya, all of Japan

[73] Assignee: NGK Insulators, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/480,746

[22] Filed: Jun. 7, 1995

[30] Foreign Application Priority Data

Dec. 28, 1994 [JP] Japan ..... 6-327687

[51] Int. Cl.[7] ..... H01B 17/32

[52] U.S. Cl. ..... 174/209; 425/129.1; 264/259; 156/173; 174/148

[58] Field of Search ..... 174/178, 209, 174/189, 174, 176, 177, 181, 183, 211, 212, 191

[56] References Cited

U.S. PATENT DOCUMENTS

| | | | |
|---|---|---|---|
| 913,439 | 2/1909 | Steinberger | 171/195 |
| 1,077,711 | 11/1913 | Hewlett | 174/191 |
| 1,768,948 | 7/1930 | Baum | 174/182 |
| 2,732,423 | 1/1956 | Morrison | 174/209 |
| 3,115,543 | 12/1963 | Morrison | 174/179 |
| 3,338,768 | 8/1967 | Kuhl | 156/293 |
| 3,495,027 | 2/1970 | Lambeth et al. | 174/140 R |
| 3,510,568 | 5/1970 | Cochran | 174/138 F |
| 4,491,687 | 1/1985 | Kaczerginski et al. | 174/178 |
| 5,406,033 | 4/1995 | Pazdirek | 174/176 |

FOREIGN PATENT DOCUMENTS

| | | | |
|---|---|---|---|
| 1137481 | 5/1957 | France | 174/209 |
| 2363170 | 3/1978 | France . | |
| 405314839 | 11/1993 | Japan | 174/209 |

*Primary Examiner*—Kristine Kincaid
*Assistant Examiner*—Kamard Cuneo
*Attorney, Agent, or Firm*—Wall Marjama Bilinski & Burr

[57] ABSTRACT

A composite insulator includes a hollow and tapered core portion composed of fiber-reinforced plastics, and a sheath and sheds composed of an insulating polymeric material integrally molded on the outer surface of the core portion. The core portions of composite insulators for a plurality of voltage classes are formed by using a mandrel assembly in which a plurality of mandrel members are combined. The so-prepared core portion is placed within a mold unit in accordance with the voltage class of the composite insulator to be manufactured, and the insulating polymeric material is poured into the mold cavity to integrally mold the sheath and the sheds.

11 Claims, 3 Drawing Sheets

SET OF HOLLOW AND TAPERED COMPOSITE INSULATORS WITH A ONE PIECE CORE

BACKGROUND OF THE INVENTION

1. Field of the Invention

The present invention relates to a composite insulator including a hollow and tapered core portion, a sheath formed on the outer peripheral surface of the core portion and a plurality of sheds which are formed on the sheath and axially spaced from each other. The present invention also relates to a method and apparatus for manufacturing such composite insulators.

2. Description of the Related Art

In general, a hollow composite insulator includes a hollow core portion consisting of fiber reinforced plastic (FRP), having an outer peripheral surface which is covered by a sheath over substantially the entire length thereof. A plurality of sheds are provided on the sheath and axially spaced from each other. The sheath and the sheds are composed of an insulating polymeric material. This type of hollow composite insulator has been actually used in practical applications, particularly in any use environment which can exploit the various functional advantages of the composite material. In this instance, silicone rubber, ethylene propylene copolymer (EPM), ethylene propylene diene terpolymer (EPDM), etc., are used as the polymeric materials for the sheath and the sheds.

Such a composite insulator is disclosed, e.g., in FR-A-2363170 wherein the insulator includes a hollow and tapered core portion which is comprised of fiber-reinforced plastics. A sheath comprised of an insulating polymeric material is integrally adhered to an outer peripheral surface of the core portion by vulcanization, for example. A band also comprised of an insulating polymeric material and having a substantially T-shaped cross section is helically wound around the sheath, so that the head of the letter T is adhered to the sheath and the legs of the letter T form the sheds which are axially spaced from each other in the longitudinal section of the insulator. In this instance, the band has two edge portions in the form of slant surfaces parallel to each other, and is wound around the sheath such that opposite edge portions of adjacent turns of the band are brought into tight contact with each other. Such an arrangement of the composite insulator makes it difficult to simplify and facilitate manufacturing operation and to improve the dimensional accuracy of the product, because the sheath and the sheds must be formed in different processes, and the band must be wound on the frustoconical outer peripheral surface of the core portion of a hollow and tapered structure while strictly maintaining a geometrical relationship whereby the opposite edge portions of the adjacent turns of the band are in a tight contact with each other.

SUMMARY OF THE INVENTION

It is therefore an object of the present invention to provide a hollow and tapered composite insulator which can be manufactured in a simplified and facilitated manner, with an improved dimensional accuracy, and also to provide a method and an apparatus for manufacturing such insulators.

In order to solve the above-mentioned drawback of the prior art, it is desirable to adopt a new technology based on an approach which is different from that of the above-described prior art, wherein the sheath and sheds are made of insulating polymeric material integrally molded on the outer peripheral surface of the core portion to manufacture a hollow and tapered composite insulator.

That is, to say, it is possible to improve the dimensional accuracy and production of the hollow and tapered composite insulator by a process wherein a hollow and tapered core portion made of fiber-reinforced plastic is placed in a mold of an appropriate molding equipment and the sheath and sheds are integrally molded by pouring or injecting the insulating polymeric material onto the outer peripheral surface of the core portion within the mold.

In this regard, it should be noted that various dimensions and shapes of hollow and tapered composite insulators are determined based on users' specification corresponding to various voltage classes. For example, the maximum inner diameter of the hollow and tapered composite insulator is specified as 270 mmϕ for 245 kV class, 360 mmϕ for 362 kV class and 486 mmϕ for 550 kV class. Also, the length of the hollow and tapered composite insulator varies in accordance with use conditions.

Thus, in order to manufacture hollow and tapered composite insulators for a plurality of voltage classes, various kinds of hollow and tapered structural bodies must be prepared with core portions having different dimensions and shapes. This means that it is necessary to prepare various mandrels and molds or molding machines, for forming different core portions and integrally molding a sheath and sheds on a selected type of the core portion. Also, the hollow composite insulator generally has an increased dimension in the case of higher voltage classes, which requires molding equipment of a large scale whereby it is difficult to lower the cost of the equipment and product.

Accordingly, it is a primary object of the present invention to provide an improved technology which is capable of eliminating the problems associated with integral molding of a sheath and sheds composed of an insulating polymeric material as mentioned above.

It is a more specific object of the present invention to provide an improved technology which makes it possible to manufacture hollow and tapered composite insulators for a plurality of voltage classes with a minimum of manufacturing facilities, thereby realizing significant reduction in product cost.

According to a first aspect of the present invention, there is provided a mandrel assembly for manufacturing a hollow and tapered structural body composed of fiber-reinforced plastics, in particular a hollow and tapered core portion for a composite insulator, comprising at least a tapered first mandrel member having a small diameter end portion and a large diameter end portion, and a tapered second mandrel member having a small diameter end portion and a large diameter end portion, said large diameter end portion of the first mandrel member having substantially the same diameter as the small diameter end portion of the second mandrel member, the first and second mandrel members being adapted to be connected to each other by, for example, press fitting, clipping or screwing, in the longitudinal axial direction, with the large diameter end portion of the first mandrel member situated adjacent to the small diameter end portion of the second mandrel member, such that a hollow and tapered structural body of a first voltage class can be manufactured by winding impregnated fibers around the first mandrel member when the first mandrel member is solely used, and a hollow and tapered structural body of a second voltage class can be manufactured by winding fiber-reinforced plastic around the first and second mandrel members when the first mandrel member is connected to the second mandrel member.

In this instance, the mandrel assembly may further comprise a small diameter cylindrical portion and a large diameter cylindrical portion adapted to be respectively connected to the small diameter end portion and the large diameter end portion of the first mandrel member when the first mandrel member is solely used. Moreover, the small diameter cylindrical portion and said large diameter cylindrical portion correspond to respective locations at both end portions of the structural body of the first voltage class, for connecting metal fittings of different diameters. That is, the cylindrical portions provide appropriately sized ends for receiving, for example, metal end fittings.

Also, the mandrel assembly may further comprise a small diameter cylindrical portion and a large diameter cylindrical portion adapted to be respectively connected to the small diameter end portion of the first mandrel member and the large diameter end portion of the second mandrel member when the first and the second mandrel members are connected to each other. Moreover, the small diameter cylindrical portion and the large diameter cylindrical portion correspond to respective locations at both end portions of the structural body of the second voltage class, for connecting metal fittings of different diameters, as explained above.

According to a second aspect of the present invention, there is provided a method for manufacturing a hollow and tapered composite insulator including a hollow and tapered core portion composed of fiber-reinforced plastics, wherein the above-mentioned mandrel assembly is used, wherein a hollow and tapered structural body of a first voltage class is manufactured by winding impregnated fibers around the first mandrel member when the first mandrel member is solely used, and wherein a hollow and tapered structural body of a second class is manufactured by winding impregnated fibers around the first and second mandrel members when the first mandrel member is connected to the second mandrel member.

According to a third aspect of the present invention, there is provided a mold assembly for manufacturing a hollow and tapered composite insulator comprising a hollow and tapered core portion composed of fiber-reinforced plastics, a sheath formed on an outer peripheral surface of the core portion, and a plurality of sheds formed on the sheath and axially spaced from each other, the sheath and the sheds being integrally molded from an insulating polymeric resin, wherein the mold assembly comprises a first mold unit for selectively accommodating a first hollow and tapered core portion and a first shape portion (i.e., a first part) of a second hollow and tapered core portion which is longer than the first core portion, said first shape portion being of a shape which is substantially common to the first hollow taper core portion and said second core portion having a second shape portion which is unique; and a second mold unit for accommodating said second shape portion of the second core portion; said first and second mold units being so arranged that a first voltage class hollow and tapered composite insulator and a portion of a second voltage class hollow and tapered composite taper insulator which corresponds to said first shape portion of the second core portion can be selectively molded by pouring the insulating polymeric material around the outer periphery of the core portion within the first mold unit, and a portion of said second voltage class composite insulator which corresponds to said second shape portion of said second core portion can be molded by pouring the insulating polymeric material around the outer periphery of the core portion within the second mold unit.

According to a fourth aspect of the present invention, there is provided a method for manufacturing a hollow and tapered composite insulator comprising a hollow and tapered core portion composed of fiber-reinforced plastics, a sheath formed on an outer peripheral surface of said core portion, and a plurality of sheds formed on said sheath and axially spaced from each other, said sheath and said sheds being integrally molded from an insulating polymeric resin, wherein the above-mentioned mold assembly is used, wherein a first voltage class hollow and tapered composite insulator and a portion of a second voltage class hollow and tapered composite taper insulator which corresponds to said first shape portion of the second core portion are selectively molded by pouring the insulating polymeric material around the outer periphery of the core portion within the first mold unit, and wherein a portion of said second voltage class composite insulator which corresponds to said second shape portion of said second core portion is molded by pouring the insulating polymeric material around the outer periphery of the core portion within the second mold unit.

With the mandrel assembly and/or mold assembly having the above-described features, it is possible to manufacture hollow and tapered composite insulators for a plurality of voltage classes with minimized manufacturing facilities, and thereby to significantly reduce the product cost.

In connection with the hollow and tapered composite insulators having different lengths and belonging to a plurality of voltage classes, the composite insulators manufactured according to the present invention by using the above-mentioned mandrel assembly and/or mold assembly are featured by a common shape portion which is substantially the same as the shortest composite insulator. Also, a relatively long composite insulator as compared to the shortest composite insulator is further featured by another shape portion which is unique for the voltage class concerned.

BRIEF DESCRIPTION OF THE DRAWINGS

The present invention will now be explained in further detail hereinafter, with reference to specific embodiments shown in the accompanying drawings, in which.

DETAILED DESCRIPTION OF THE PREFERRED EMBODIMENT

Figure 1A:
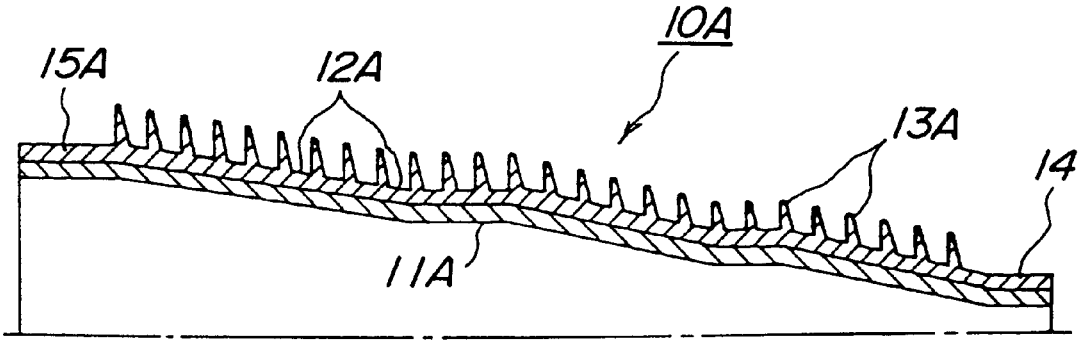
FIGS. 1*a*, 1*b* and 1*c* are sectional views showing an example of a group of hollow and tapered composite insulators for different voltage classes according to the present invention.

Referring now to the drawings, FIG. 1*a* shows a hollow and tapered composite insulator 10A belonging to a voltage class A (e.g., 550 kV class). The insulator 10A includes a hollow and tapered core portion 11A made of fiber-reinforced plastics, a sheath 12A formed on the core portion 11A, and a plurality of sheds 13A formed on the sheath 12A and axially spaced from each other. The sheath 12A and the sheds 13A are integrally formed by molding, on the outer peripheral surface of the core portion 11A, an insulating polymeric resin such as silicone rubber, ethylene propylene copolymer (EPM), ethylene propylene diene terpolymer (EPDM), polyurethane and the like. The insulator 10A has substantially cylindrical axial end portions 14 and 15A for fixedly securing appropriate metal fittings (not shown).

Figure 1B:
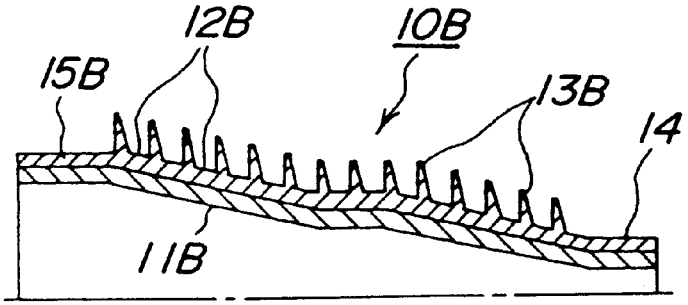

Similarly, FIG. 1*b* shows a hollow and tapered composite insulator 10B belonging to a voltage class B (e.g., 362 kV class). The insulator 10B includes a hollow and tapered core portion 11B made of fiber-reinforced plastics, a sheath 12B formed on the core portion 11B, and a plurality of sheds 13B formed on the sheath 12B and axially spaced from each other. The sheath 12B and the sheds 13B are integrally formed by molding an insulating polymeric material on the outer peripheral surface of the core portion 11B. The insulator 10B has substantially cylindrical axial end portions 14 and 15B for fixedly securing appropriate metal fittings (not shown).

Figure 1C:
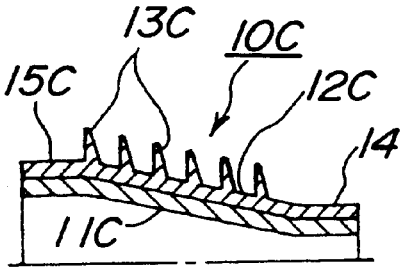

Also, FIG. 1*c* shows a hollow and tapered composite insulator 10C belonging to a voltage class C (e.g., 245 kV class). The insulator 10C includes a hollow and tapered core portion 11C made of fiber-reinforced plastics, a sheath 12C formed on the core portion 11C, and a plurality of sheds 13C formed on the sheath 12C and axially spaced from each other. The sheath 12C and the sheds 13C are integrally formed by molding an insulating polymeric material on the outer peripheral surface of the core portion 11C. The insulator 10C has substantially cylindrical axial end portions 14 and 15C for fixedly securing appropriate metal fittings (not shown).

It will be appreciated from the comparison of FIGS. 1*a*, 1*b* and 1*c* with each other, the composite insulator 10A of the voltage class A has the largest length, the composite insulator 10B of the voltage class B has a medium length, and the composite insulator 10C of the voltage class C has the smallest length among these voltage classes. The composite insulator 10A having the largest length and belonging to voltage class A has a shape portion (i.e., a part) which is substantially common to the composite taper insulator 10B of medium length and belonging to voltage class B, except for the region on the side of the large diameter end portion. Similarly, the composite insulator 10B of medium length and belonging to voltage class B has a shape portion which is substantially common to the composite insulator 10C having the smallest length and belonging to voltage class C, except for the region on the side of the large diameter end portion.

In order to manufacture the hollow and tapered composite insulators 10A, 10B and 10C belonging to a plurality of the voltage classes A, B and C, it is necessary to prepare various types of hollow and tapered core portions 11A, 11B and 11C each having substantially common portions in the region of the small diameter end portion. In this regard, it is particularly advantageous to use a mandrel assembly 20 shown in FIGS. 2*a*, 2*b* and 2*c* to form the various types of core portions 11A, 11B and 11C.

Figure 2A:
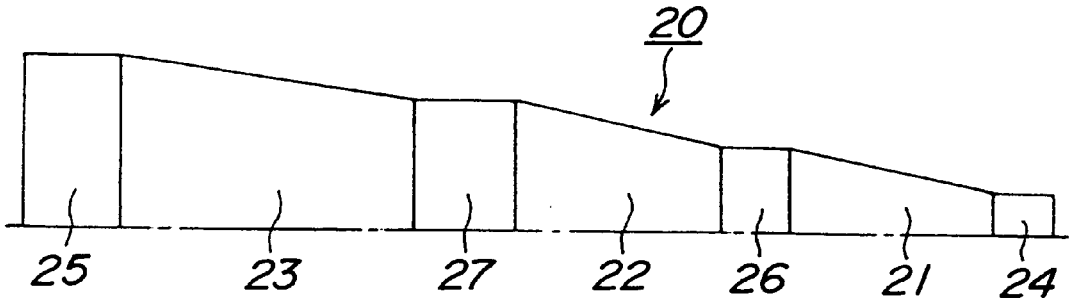
FIGS. 2*a*, 2*b* and 2*c* are sectional views showing a preferred embodiment of the mandrel assembly according to the present invention, which can be used for manufacturing the hollow and tapered composite insulators for different voltage classes.
Figure 2B:
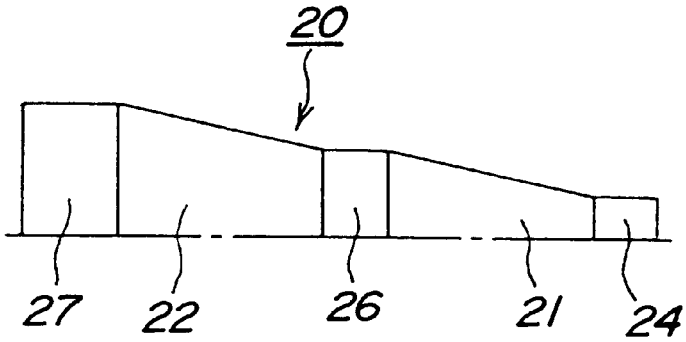
Figure 2C:
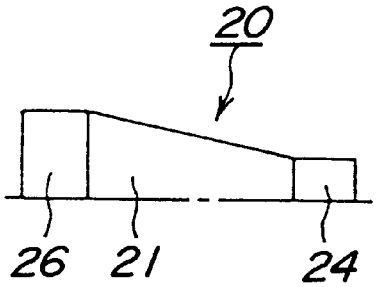

Referring to FIGS. 2*a*, 2*b* and 2*c*, the mandrel assembly 20 includes a first mandrel member 21, a second mandrel member 22 and a third mandrel member 23 which are tapered, respectively. The diameter of the first mandrel member 21 at the large diameter end portion is substantially same as the diameter of the second mandrel member 22 at the small diameter end portion. Further, the diameter of the second mandrel member 22 at the large diameter end portion is substantially same as the diameter of the third mandrel member 23 at the small end portion. These mandrel members 21, 22 and 23 are axially aligned with, and detachably connected to each other by, for example, press fitting, clipping or screwing. A cylindrical end member 24 is provided at the small diameter end portion of the first mandrel member 21. Another cylindrical end member 25 is provided at the large diameter end portion of the third mandrel member 23. Further, a cylindrical joint member 26 is arranged between the large diameter end portion of the first mandrel member 21 and the small diameter end portion of the second mandrel member 22. Another cylindrical joint member 27 is arranged between the large diameter end portion of the second mandrel member 22 and the small diameter end portion of the third mandrel member 23. Joint members 26, 27 are preferably made from the same material as mandrel members 21, 22, 23 and add a predetermined length to the overall final mandrel assembly 20. In the case of joint members 27, 26, 24, these joint members effectively define the small diameter end portion of mandrel members 23, 22, 21, respectively. These components can be used in appropriate combinations according to the voltage classes A, B and C which correspond to the core portions 11A, 11B and 11C to be formed.

First of all, the mandrel assembly 20 wherein all of the above-mentioned mandrel members 21, 22 and 23 are connected to each other, as shown in FIG. 2*a*, is used to form the hollow and tapered core portion 11A which corresponds to the hollow and tapered composite insulator 10A having the largest length and belonging to voltage class A, by winding plastic resin-impregnated reinforcing fibers, e.g., glass fibers, on the outer peripheral surfaces of the respective mandrel members 21, 22 and 23. In this case, the end members 24 and 25 attached to the small diameter end portion of the first mandrel member 21 and the large diameter end portion of the third mandrel member 23 form the cylindrical portions 14 and 15 for the metal fittings of the composite insulator 10A for the voltage class A.

Furthermore, the mandrel assembly 20 wherein the first mandrel member 21 and the second mandrel member 22 are connected to each other and the third mandrel member 23 is not used, as shown in FIG. 2*b*, is used to form the hollow and tapered core portion 11B which corresponds to the composite insulator 10B having the medium length and belonging to voltage class B, by winding the resin-impregnated reinforcing fibers on the outer peripheral surfaces of the respective mandrel members 21 and 22. In this instance, the end member 24 attached to the small diameter end portion of the first mandrel member 21 and the joint member 27 disposed at the large diameter end portion of the second mandrel member 22 form the cylindrical portions 14 and 15B for the metal fittings of the composite insulator 10B for voltage class B.

Finally, the mandrel assembly 20 including the first mandrel member 21 only, without the second mandrel member 22 and the third mandrel member 23, as shown in FIG. 2*c*, is used to form the hollow and tapered core portion 11C which corresponds to the composite insulator 10C having the shortest length and belonging to voltage class C, by winding the resin-impregnated reinforcing fibers on the outer peripheral surface of the mandrel member 21. In this case, the end member 24 attached to the small diameter end portion of the first mandrel member 21 and the joint member 26 disposed at the large diameter end portion of the first mandrel member 21 form the cylindrical portions 14 and 15C for the metal fittings of the composite insulator 10C for voltage class C.

With the mandrel assembly 20 which can be used by suitably combining the multiple mandrel members 21, 22 and 23 in accordance with voltage classes A, B and C corresponding to the hollow and tapered core portions 11A, 11B and 11C to be molded, it is unnecessary to prepare individual mandrels corresponding to the respective voltage classes A, B and C. Further, the first mandrel member 21 is commonly used for molding the hollow and tapered core portions 11A, 11B and 11C for all the voltage classes A, B and C, and the second mandrel member 22 is commonly used for molding the hollow and tapered core portion 11A for voltage class A and the hollow taper core portion 11B for voltage class B. It is thus possible to significantly reduce the cost of the manufacturing equipment and the product.

Figure 3A:
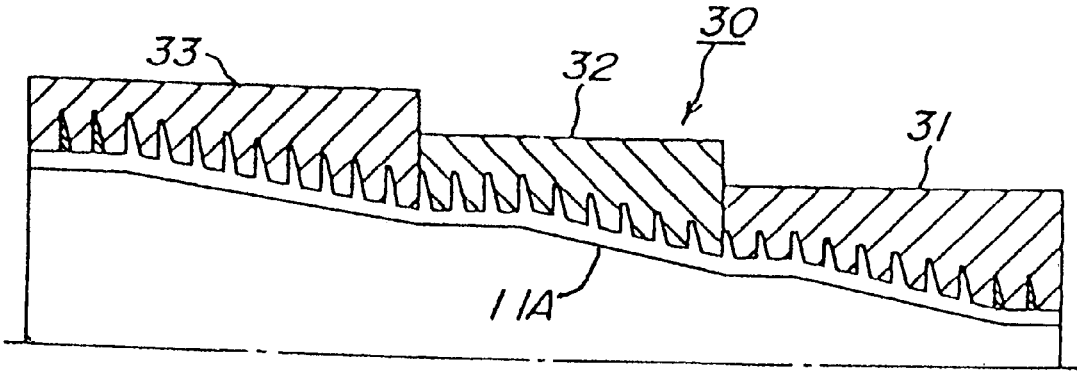
FIGS. 3*a*, 3*b* and 3*c* are sectional views showing an embodiment of a metal mold assembly according to the present invention, which also can be used for manufacturing the hollow and tapered composite insulators for different voltage classes.
Figure 3B:
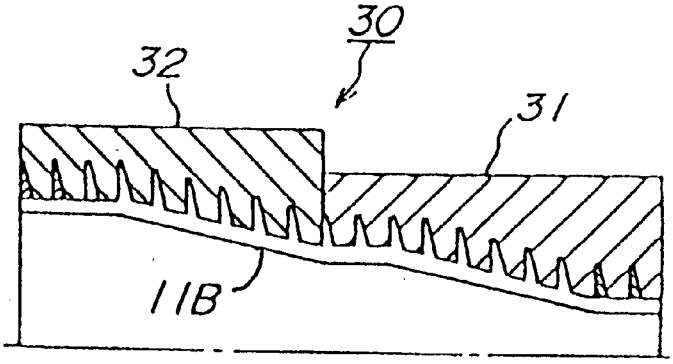
Figure 3C:
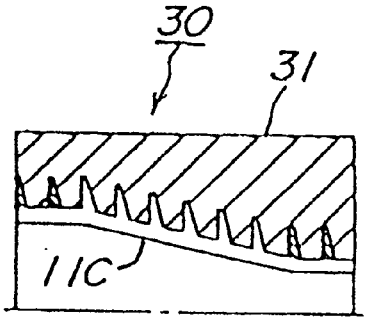

In order to manufacture the hollow and tapered composite insulators 10A, 10B and 10C for a plurality of voltage classes A, B and C by using the various hollow and tapered core portions 11A, 11B and 11C having the shape portions which are substantially common in the regions of the small diameter end portions, it is particularly advantageous to employ a mold assembly 30 shown in FIGS. 3*a*, 3*b* and 3*c*.

As shown in FIGS. 3*a*, 3*b* and 3*c*, the mold assembly 30 includes a first mold unit 31, a second mold unit 32 and a third mold unit 33, and can be used by appropriately combining these mold units in accordance with the voltage classes A, B and C of the hollow and tapered composite insulators 10A, 10B and 10C to be manufactured. Adjacent mold units 31, 32 and 33 of the mold assembly 30 are detachably connected with each other.

As shown in FIG. 3*a*, the composite insulator 10A for voltage class A (see FIG. 1*a*) is manufactured by placing the core portion 11A having the largest length and corresponding to voltage class A in the mold assembly 30 with all of the above-mentioned mold units 31, 32 and 33 connected to each other, and pouring an insulating polymeric material into the mold cavity to integrally mold the sheath 12A and the sheds 13A on the outer peripheral surface of the core portion 11A.

Further, as shown in FIG. 3*b*, the composite insulator 10B for voltage class B (see FIG. 1*b*) is manufactured by placing the core portion 11B having the medium length and corresponding to voltage class B in the mold assembly 30 wherein the first and second mold units 31 and 32 are connected to each other and the third mold unit 33 is excluded, and pouring the insulating polymeric material into the mold cavity to integrally mold the sheath 12B and the sheds 13B on the outer peripheral surface of the core portion 11B.

Finally, as shown in FIG. 3*c*, the composite insulator 10C for voltage class C (see FIG. 1*c*) is manufactured by placing the core portion 11C having the smallest length and corresponding to voltage class C in the mold assembly 30 using only the first mold unit 31 without the second and third mold units 32 and 33, and pouring the insulating polymeric material into the mold cavity to integrally mold the sheath 12C and the sheds 13C on the outer peripheral surface of the core portion 11C.

In this manner, with the mold assembly 30 which is capable of using a plurality of mold units 31, 32 and 33 in appropriate combinations in accordance with the voltage classes A, B and C of the composite insulators to be manufactured, it is unnecessary to prepare individual molds corresponding to the respective voltage classes A, B and C. Moreover, the first mold unit 31 is commonly used for manufacturing the composite insulators 10A, 10B and 10C belonging to all the voltage classes A, B and C, and the second mold unit 32 is commonly used for manufacturing the composite taper insulators 10A having the largest length and belonging to the voltage class A, as well as composite insulator 10B having the medium length and belonging to voltage class B. It is thus possible to significantly reduce the cost of the manufacturing equipment and the product.

Although not shown in the drawings, there may be adopted a method in which a mold locking device of the molding equipment corresponds to a single mold unit only and the different mold unit 31, 32 or 33 is connected to the mold locking device to stepwisely form the composite insulator 10B or 10A having the medium or largest length and belonging to voltage class B or A. That is, when the first mold unit 31 is connected to the mold locking device, it is possible to manufacture the composite insulator 10C for voltage class C, or to form the shape portion of the composite insulator 10B or 10A for the voltage class B or A, which is substantially common to the composite insulator 10C for voltage class C. Further, when the second mold unit 32 is connected to the mold locking device in the second stage, it is possible to mold the shape portion of the composite insulator 10B for voltage class B, which is unique as compared to the composite insulator 10C for voltage class C, or to form the shape portion of the composite insulator 10A for voltage class A, which is substantially common to the above-mentioned unique shape portion of the composite insulator 10B for voltage class B. Finally, when the third mold unit 33 is connected to the mold locking device in the third stage, it is possible to form the unique shape portion, i.e., the leftmost tapered segment shown in FIG. 1*a*, of the composite insulator 10A for voltage class A as compared to the composite insulator 10B for voltage class B.

It will be appreciated from the foregoing description that, in accordance with the present invention, it is possible to manufacture various types of hollow and tapered composite insulators corresponding to a plurality of voltage classes, with minimized manufacturing facilities and at a significantly reduced cost.

The above-mentioned specific embodiments were presented by way of examples only, and various modifications and variations may be made without departing from the scope of the invention as defined by the appended claims.

For example, in order to manufacture the composite insulators 10A and 10B having the largest and medium lengths and belonging to voltage classes A and B respectively, it may be possible to employ an arrangement in which the large diameter end portion of the first mandrel member 21 and the small end portion of the second mandrel member 22 are directly connected to each other, and the large diameter end portion of the second mandrel member 22 and the small end portion of the third mandrel member 23 are directly connected to each other, without using the joint members 26 and 27. Furthermore, if necessary, the length and/or the taper angle of each mandrel member of course may be changed appropriately.

We claim:

1. A set of hollow and tapered composite insulators, comprising:

a first voltage class insulator comprising a first one-piece hollow and tapered core having a first shape and a first length; and a second voltage class insulator comprising a second one-piece hollow and tapered core having a second shape different from said first shape and a second length longer than said first length, said second core having a first shape portion substantially common to the first shape of said first core and a second shape portion which is different from the first shape of said first core, wherein each of said insulators of said set of insulators includes a single sheath formed on an outer peripheral surface of each of said first and second cores, respectively, and a plurality of sheds formed on the single sheath and axially spaced from each other, the single sheath and sheds being integrally molded from an insulating polymeric resin.

2. The set of composite insulators of claim 1, further comprising a third voltage class insulator comprising a third one-piece hollow and tapered core having a third shape different from said first and second shapes and a third length longer than said second length, said third core having a first shape portion substantially common to the second shape of said second core and a second shape portion which is different from the second shape of said second core.

3. The set of composite insulators of claim 2, wherein said first core includes at least two cylindrical regions with a conical region interposed therebetween, and the cylindrical regions of said first core extend parallel to one another.

4. The set of composite insulators of claim 3, wherein said third core includes at least four cylindrical regions with conical regions interposed between each pair of adjacent ones of said cylindrical regions, and the cylindrical regions of said third core extend parallel to one another and the conical regions of said third core extend parallel to one another.

5. The set of composite insulators of claim 3, wherein said second core includes at least three cylindrical regions with conical regions interposed between each pair of adjacent ones of said cylindrical regions, and the cylindrical regions of said second core extend parallel to one another and the conical regions of said second core extend parallel to one another.

6. The set of composite insulators of claim 5, wherein said third core includes at least four cylindrical regions with conical regions interposed between each pair of adjacent ones of said cylindrical regions, and the cylindrical regions of said third core extend parallel to one another and the conical regions of said third core extend parallel to one another.

7. The set of composite insulators of claim 2, wherein said second core includes at least three cylindrical regions with conical regions interposed between each pair of adjacent ones of said cylindrical regions, and the cylindrical regions of said second core extend parallel to one another and the conical regions of said second core extend parallel to one another.

8. The set of composite insulators of claim 7, wherein said third core includes at least four cylindrical regions with conical regions interposed between each pair of adjacent ones of said cylindrical regions, and the cylindrical regions of said third core extend parallel to one another and the conical regions of said third core extend parallel to one another.

9. The set of composite insulators of claim 1, wherein said first core includes at least two cylindrical regions with a conical region interposed therebetween, and the cylindrical regions of said first core extend parallel to one another.

10. The set of composite insulators of claim 9, wherein said second core includes at least three cylindrical regions with conical regions interposed between each pair of adjacent ones of said cylindrical regions, and the cylindrical regions of said second core extend parallel to one another and the conical regions of said second core extend parallel to one another.

11. The set of composite insulators of claim 1, wherein said second core includes at least three cylindrical regions with conical regions interposed between each pair of adjacent ones of said cylindrical regions, and the cylindrical regions of said second core extend parallel to one another and the conical regions of said second core extend parallel to one another.

* * * * *